United States Patent [19]

Barbee

[11] 4,137,284

[45] Jan. 30, 1979

[54] CARBURETOR

[76] Inventor: Boyd D. Barbee, 1941 63rd Ave., Sacramento, Calif. 95823

[21] Appl. No.: 825,621

[22] Filed: Aug. 18, 1977

[51] Int. Cl.[2] ..... F02M 9/12

[52] U.S. Cl. ..... 261/44 B; 261/48; 251/362

[58] Field of Search ..... 261/48, 44 B, 44 D; 251/362

[56] References Cited

U.S. PATENT DOCUMENTS

| | | | |
|---|---|---|---|
| 1,038,050 | 9/1912 | Wills | 261/48 |
| 1,140,525 | 5/1915 | Motsinger | 261/48 |
| 1,178,064 | 4/1916 | Fahrney | 261/48 |
| 1,218,085 | 3/1917 | Jay | 261/44 D |
| 1,233,503 | 7/1917 | Peterson | 261/48 |
| 1,590,059 | 6/1926 | Reents et al. | 261/48 |
| 2,118,038 | 5/1938 | Brodersen et al. | 261/44 D |
| 2,828,116 | 3/1958 | Bascle, Jr. | 261/50 A |
| 3,291,462 | 12/1966 | Mennesson | 261/52 |
| 3,335,999 | 8/1967 | Lowrey | 251/362 |
| 3,943,205 | 3/1976 | Oliver | 261/DIG. 78 |
| 3,957,930 | 5/1976 | Birmingham | 261/44 B |
| 4,001,356 | 1/1977 | Graybill | 261/40 |
| 4,054,621 | 10/1977 | Bubniak et al. | 261/DIG. 56 |

*Primary Examiner*—Tim R. Miles

*Attorney, Agent, or Firm*—Mark C. Jacobs

[57] ABSTRACT

A carburetor for controlling the air-fuel mixture entering a carburetor, atomizing the same, and flowing the atomized mixture to the manifold of a vehicle without touching any of the internal surfaces of the carburetor thereby preventing formation of the atomized mixture into liquid thus improving engine operation and efficiency.

18 Claims, 12 Drawing Figures

CARBURETOR

BACKGROUND OF THE INVENTION

1. Field of the Invention

The invention relates to internal combustion engines; and, more particularly, to an improved carburetor for internal combustion engines.

2. Description of the Prior Art

Conventional carburetors are inefficient due to poor atomization of the fuel. In prior art carburetors, fuel is sprayed directly against the side of the carburetor intake throat and its throttle valve. The fuel is washed from the surfaces of the throat and throttle valve to fall as droplets into recesses in the manifold directly under the throat of the carburetor. This area, being specially heated, is called the hot spot. The function of the hot spot is to evaporate the liquid formed in the recesses by the droplets. Even with this precaution, a portion of the fuel still enters the cylinder as a liquid by travelling unevaporated along the manifold walls. The larger droplets in the mixture are considerably heavier than the mixture with which they are travelling and this causes them to want to continue in the direction in which they are moving. When the mixture tries to make a turn to enter another passage, the heavier particles will continue straight ahead until they reach a dead end, rather than make the turn. This is the reason the end cylinders in many engines utilizing such prior art carburetors run richer than the middle cylinders. The end cylinders get most of the unvaporized fuel in addition to the vaporized fuel they take in, and the middle cylinders get only vaporized fuel.

Good mixture distribution is important to smooth engine operation, brisk throttle response and reasonable fuel mileage. The only way to improve mixture distribution in present manifolds and carburetors is to heat the mixture after it leaves the carburetor. If the mixture is heated, the volumetric efficiency is decreased and therefore maximum torque and power are reduced. Heating the mixture encourages gum deposits in the manifold, causes pre-flame reactions and engine knock.

There is thus a need for increasing the efficiency of such prior art carburetors. Such an improved carburetor will produce lower emissions, improve fuel economy and carburetion, increase horsepower and easier starting under hot and cold conditions.

SUMMARY OF THE INVENTION

It is an object of this invention to provide an improved carburetor for internal combustion engines.

It is a further object of this invention to provide an improved carburetor in which the exact amount of fuel and air is synchronized and can be preset to form any desired air-fuel ratio.

It is still another object of this invention to carry out the foregoing objects while improving carburization and fuel economy, produce lower emissions, increase horsepower and provide easier starting under hot and cold conditions.

These and other objects are preferably accomplished by providing a carburetor which atomizes the air-fuel mixture and flows it to the manifold of a vehicle without touching internal surfaces of the carburetor which might liquidize some of the mixture and cause engine foulup and poor performance. The carburetor includes an improved movable valve which controls the amount of air entering the throat of the valve, the rise and fall of the valve being adjustable.

BRIEF DESCRIPTION OF THE DRAWING

FIG. 4(*b*) is a sectional view along line VI—VI of FIG. 4

FIG. 8(*b*) is an elevational view of one portion of the carburetor of FIG. 1, namely that portion between IV and V, partially exploded; with some components not shown.

DESCRIPTION OF THE PREFERRED EMBODIMENT

Figure 1:
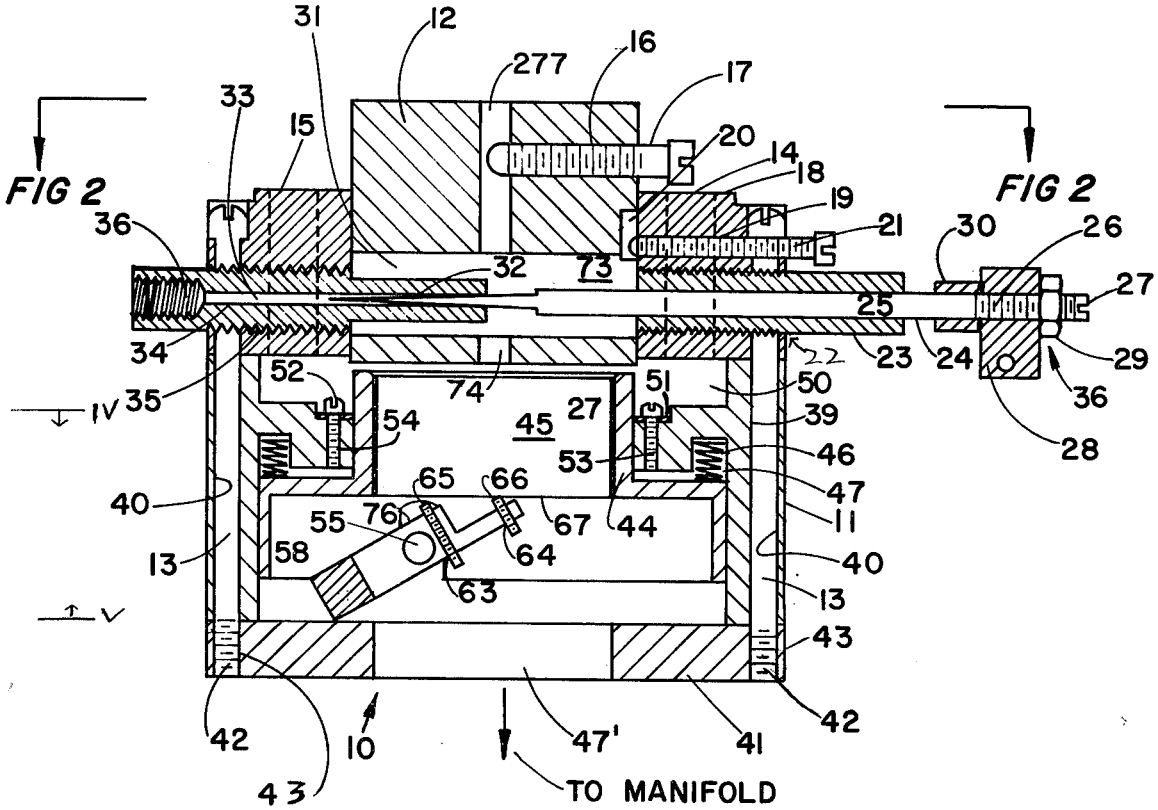
FIG. 1 is a vertical cross-sectional view of a carburetor in accordance with the teachings of the invention.
Figure 2:
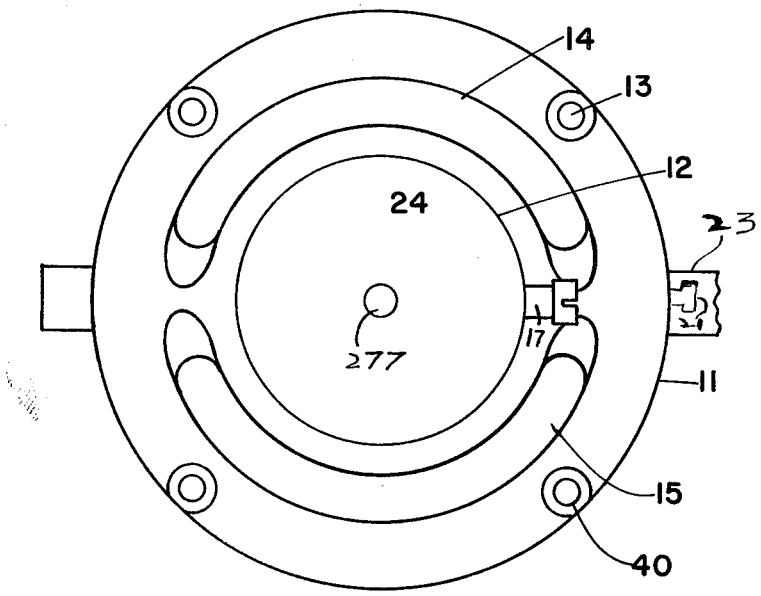
FIG. 2 is a top plan view of the carburetor of FIG. 1 taken along lines 2—2 thereof.

Referring now to FIG. 1 of the drawing, a carburetor 10 is shown having a main housing 11 closed off by a seal block 12 at the top thereof (FIG. 2). As is well known in the art, air is introduced into carburetor 10 through the air intake port 277 in seal block 12. Further, as shown in FIG. 2, seal block 12 is surrounded by arcuate air intake slots 14, 15 in head portion 18 communicating the interior of carburetor 10 with the atmosphere thereby providing a main air supply of incoming air to carburetor 10.

A threaded opening 16 extends traversely through seal block 12 (FIG. 1) communicating with both intake port 277 and the exterior of carburetor 10. An adjustment screw 17 is threaded in opening 16 for providing fine air adjustment for the air entering carburetor 10 through seal block 12. The upper end or head portion 18 on housing 11 includes a threaded aperture 19 communicating with both the exterior of carburetor 10 and the area of carburetor 10 normally occupied by seal block 12. Seal block 12 has an opening 20 at its lower end with a threaded set screw 21 threaded in aperture 19 and entering opening 20 for holding seal block 12 in a solid, level and prealigned position in head portion 18. By this means of adjustment, seal block 12 may be held against valve 44, as will be discussed, so it remains sealed.

Figure 3:
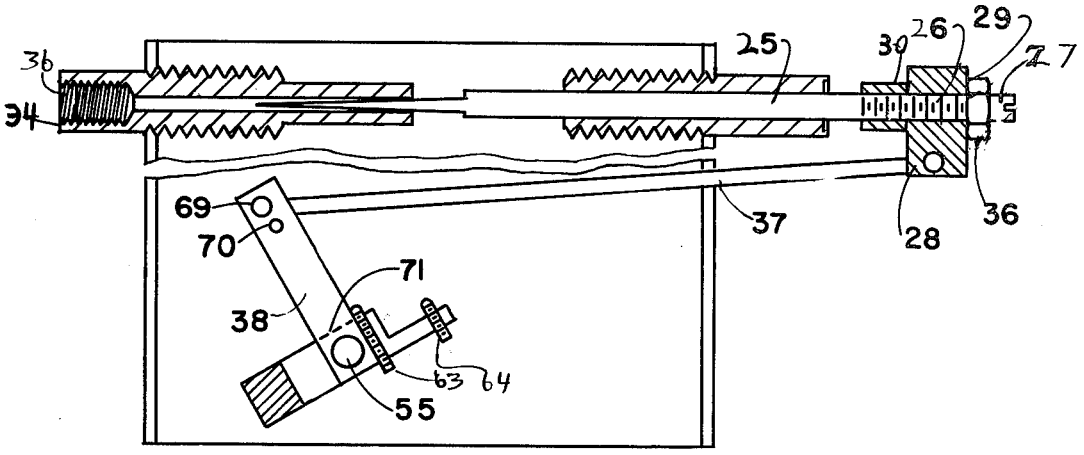
FIG. 3 is a vertical, partly cross-sectional, view of various components of the carburetor of FIG. 1.

A second larger diameter threaded aperture 22, aligned with aperture 19, also extends through head portion 18 below aperture 19 for receiving therein a threaded bore 23. A needle shaft 24, having a smooth main portion 25 and a threaded end 26 terminating in a slotted head 27, extends through a block 28, threaded on threaded end 26, retained thereon by a lock nut 29. A spacing block 30 may also be threaded on end 26 between boss 23 and block 28. Needle shaft 24 extends through boss 23, which acts as a guide therefore, and across passage 31, transverse to port 277, in head portion 18. Needle shaft 24 has a tapered or needle end 32 which enters a port 33 in a threaded boss 34 threaded in an opening 35 in head portion 18. Boss 34 terminates in an internally threaded end 36 for coupling the same to an inlet fuel line (not shown) on the vehicle. By selectively loosening and tightening nut 29, block 28 can be moved to laterally move needle end 32 in port 33 to adjust the idle for the vehicle. Block 28 also acts as an anchoring point for a linkage rod 37 (FIG. 3) which connects a cam operating arm 38 to metering needle 24 so that the two parts may move in unison for synchronization as will be discussed further hereinbelow.

Referring again to FIG. 1, main housing 11 includes an internal barrel center cylinder 39 below head portion 18 and spaced from the internal wall 40 of housing portion 11. See FIG. 2 for a better understanding. Wall 40 is in fact one wall of the bolt hole 13. The lower end or bottom of housing portion 11 is closed off by an adapter plate 41 retained in position by suitable screws 42 and threaded apertures 43 in housing portion 11.

Cylinder 19 acts as a guide for an atomizing valve 44 having a central throat chamber 45. Valve 44 is adapted to be raised and lowered to seal against seal block 12, as will be discussed. 13 designates a plurality of block bolt holes.

Cylinder 39 includes a plurality of recesses 46 receiving therein springs 47 which abut against valve 44 and assure valve 44 will drop under the action of the aforementioned camming means. Although any suitable number of recesses and springs may be provided, four equally spaced springs (only two visible in FIG. 1) are preferred.

Figure 4A:
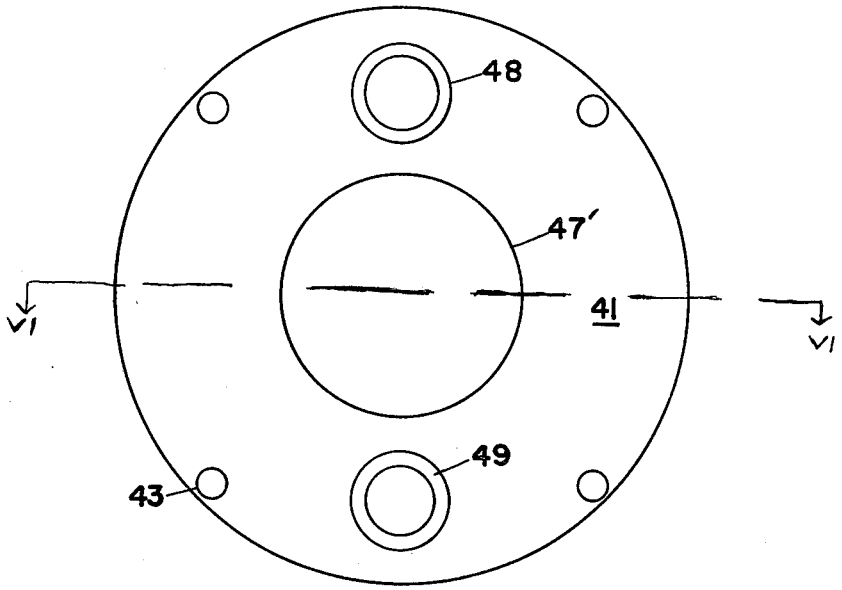
FIG. 4(*a*) is a plan view of an adaptor plate that fits on the bottom of the carburetor of FIG. 1.
Figure 4B:
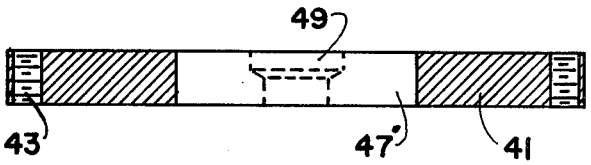

Adapter plate 41, as seen in bottom view in FIGS. 4*a* & *b*, has a central opening 47' with smaller apertures 48,49 on each side thereof, plate 41 being adapted to be coupled to a conventional manifold (not shown) mounted on the vehicle engine. Openings 47', 48 and 49 thus communicate with the manifold as is well known in the automotive art. The adaptor plate of FIG. 4 is seen to be an interface between the manifold 82 and the device 10. In FIG. 1 it is shown mounted to the device 10. Threaded aperture 43 communicates with bolt hole 13 for holding bolt 42 therein to attach the plate 41 to the barrel 11. In FIG. 4*b*, opening 47' is seen as are mounting holes 43 to go upward and 48 and 49 to go downward to the manifold.

An annular air intake chamber 50 is formed between head portion 18 and cylinder 39 and valve 44. An annular seal 51 is provided in an annular recess 52 in cylinder and retained therein by stud bolts 53 threaded in suitable apertures 54 in recess 52 of cylinder 39. Bolts 53 retain seal 51 in position. Seal 51 is thus secured to cylinder 39 and encircles valve 44 thereby preventing air from leaking past the outside of valve 44.

As discussed, as particularly contemplated in the present invention, camming means are provided for raising and lowering valve 44. In the exemplary embodiment of the invention, such camming means includes a pair of cam shafts 55,56 (see also FIG. 5) threaded into a suitable aperture 57 in a semi-circular cam 58. Cam shafts 55,56 can be seen on the exterior of housing portion 11 in FIG. 3, on both sides of housing portion 11 in FIG. 8 and cam shafts 55,56 and cam 58 alone can be seen in plan view in FIG. 5. It is to be understood that cam 58 is pivotally mounted in suitable apertures 59,60 (FIG. 8) in housing portion 11 so that cam 58 may be moved up and down in FIG. 1 about its pivot points.

Figure 5:
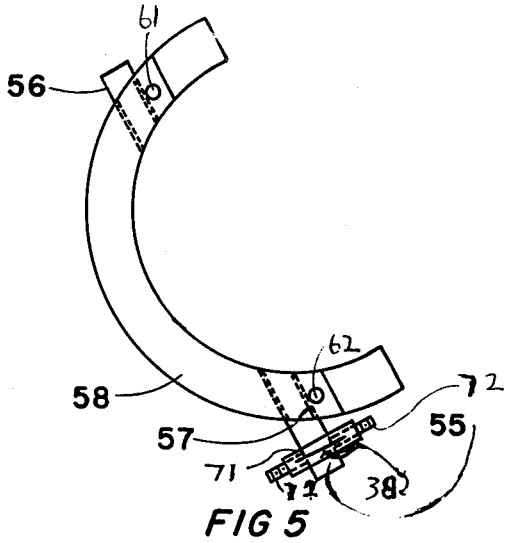
FIG. 5 is a detailed plan view of one component of the carburetor of FIG. 1.

As seen in FIG. 5, a pair of spaced threaded apertures 61,62 are provided in cam 58 for receiving set screws 63,64 (FIG. 1). These set screws 63,64 may be of differing lengths and threadably adjustable so as to be able to vary the rise and fall of valve 44. The heads 65,66 (FIG. 1) of screws 63,64 respectively, thus may be selectively adjusted to bear against the bottom surface 67 of valve 44.

Linkage rod 37 thus couples the fuel and air controls together. Rod 37 is thus coupled to both block 28 and retained thereon by suitable connecting means (not visible). The other end of rod 37 is connected to cam operating arm 38 by a suitable screw 69 or other means and arm 38 may have spaced apart apertures 70 so as to be able to adjust the point of connection of rod 37 to arm 30. Arm 38 is of course coupled to cam shaft 55 by a suitable block 71 (see also FIG. 5) having threaded set screws 72 for tightening block 71 to shaft 55. Adjustment is to be made by moving block 38 along the threaded metering needle shaft 24 and locating rod 37 in one of the spaced apertures 70 of arm 48.

As shown in FIG. 1, an adjustment slot 73 is provided within seal block 12 for allowing movement of seal block 12 against valve 44. A secondary air intake port 74 is aligned with hole 13. The apertures 48,49 allow plate 41 to be bolted to the manifold. A recess 75 is provided in plate 41 (FIG. 4) accomodating cam 58 and allowing oscillation thereof. Opening 47' acts as a throat to the manifold. A slot 76 (see also FIG. 6) is provided in valve 44 receiving therein shafts 55,56 on cam 58 permitting the raising and lowering of valve 44. The top of valve 44 is shown in FIG. 7 and has a plurality of primary idle air notches 77.

The improved valve of this invention is designed to be placed in the body of the carburetor in order to force the air to impact upon itself in the center of the valve throat and to impinge on the fuel which enters into the throat center at the top of the atomizing valve.

The design of the valve doubles the impact force and causes a turbulence which is impossible with standard carburetors.

In operation, the main fuel metering orifice or threaded end 36 receives fuel from the fuel pump of the vehicle into port 33. The lateral movement of needle shaft 24, in response to the throttle pedal of the vehicle as heretofore described, acts as a variable fuel jet by extending or retracting needle end 32 into the path of fuel flow and thus regulates the flow of fuel into the incoming air stream in recess 74. Fuel for idling is set by laterally adjusting the extent of end 32 into port 33 as heretofore described. Idle fuel adjustment is thus independent of operation fuel.

Intake air for operation under power is controlled by the main atomizing valve 44 which is connected to and sychronized with the tapered rod or needle shaft 24. As this shaft is connected to the throttle pedal, which may be coupled by suitable linkage to cam arm 38, and the atomizing valve 44 is connected to shaft 24 via linkage rod 37 and arm 38, they are operated in unison. Idle air is released through valve 44 via notches 77. Notches 77 are thus air channels of a size slightly smaller than is necessary for supplying the correct amount of air for idle. The remaining amount of air is adjusted by means of air adjustment screw 17. This allows the idle speed to be finely set with respect to the idle fuel for idle revolutions per minute. When valve 44 is in a fully raised position, it is positioned against seal block 12 in a predetermined position to abut against the seal block, to prevent air from seeping through except for the designated channels.

Figure 6:
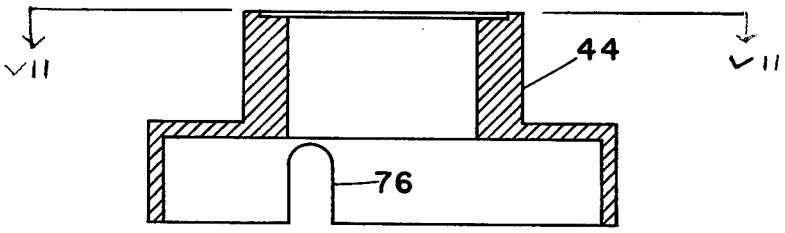
FIG. 6 is a vertical cross-sectional view of another component of the carburetor of FIG. 1.
Figure 7:
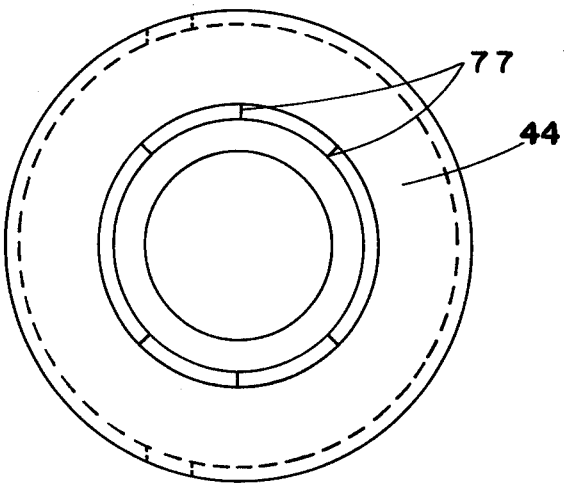
FIG. 7 is a top plan view of the component of FIG. 6 taken along lines VII—VII thereof.

For ease of understanding, of slot 76, notches 77 and valve 44, reference should be best made to FIGS. 6 and 7.

Since the operating fuel is fed into the air stream under pressure, the need for an accelerator pump is eliminated. When metering needle shaft 24 is withdrawn from port 33 by the depression of the throttle pedal, a charge of fuel is immediately released into the air stream. Since the revolutions per minute of the engine have not increased at this point, the charge of fuel causes an enrichment which increases the power to increase the rpms for maximum torque or cruise. Cruise or wide open throttle is provided by stepping on the throttle pedal to withdraw needle shaft 24 thereby releasing a regulated amount of fuel, at the same time regulating the amount of air needed to pass through valve 44.

Introducing the metered fuel with the metered air, in the air to fuel ratio desired, mixes the air and fuel homogeneously. This is accomplished by bringing the fuel into carburetor 10 via the metering jet of fuel and air above throat or port 74 of valve 44. While labelled 74, this is actually the exit of intake port 277, i.e. a hole drilled through seal block 12.

Since the idle air is set by notches 77 across the face of valve 44, the air converges at the center of throat or port 74 which of course is the point of entry for the metered fuel supply. Additional air for fine adjustment of rpms is provided via screw 17.

Cam 58, which is synchronized with the throttle via suitable linkage, raises and lowers valve 44 against the bias of springs 47 to thus control the amount of air required to form the desired air-fuel ratio. The length and position of set screws 63 & 64 may be adjusted to regulate the rise and fall of valve 44 and thus preset a desired air-fuel ratio.

It can be seen that a carburetor is described which avoids problems of starting engines in cold climates since it provides a fuel that will enable an engine to start in less then ten revolutions. It has been found that an air mixture of about thirteen to one is best for satisfactory starting. This is based upon the fact that a conventional carburetor must be set to deliver a one to one air-fuel mixture under full choke conditions in order to hopefully vaporize 7.7% of the fuel, to give the desired thirteen to one air-fuel ratio.

In a conventional carburetor, if only 7.7% of the fuel vaporizes in a cold engine, the remaining 83.3% of the fuel travels through the engine and emerges as both a pollutant and a dilutant in the crankcase oil. Due to poor atomization of conventional carburetors, far too much fuel is required to produce sufficient vapor for satisfactory starting.

In the improved carburetor of the instant invention, fuel is atomized to a mist without heavy droplets. This in turn creates more surface area to produce the vapor required for cold starts; therefore, less fuel is required to produce the desired 13:1 air-fuel ratio, thus saving fuel and cutting down on emissions.

Fuel is not easily vaporized at any intake air temperature. In the carburetor of the invention, fuel is atomized into a fine mist with an increased amount of low temperature vapor. This combination of low temperature mist and vapor is desirable for efficient operation as there is a minimum of droplets in the air stream which have a tendency to enrich only the cylinders at each end of the manifold. In the carburetor disclosed herein, a more even distribution of fuel for each cylinder is obtained.

In the carburetor of the instant invention, valve 44, cam 58, notches 77, etc. combine to force the intake air to impact against itself in the center of throat or chamber 45. At this point, the air is forced to change direction 90° and flow down chamber or throat 45 and enter the manifold via engine vacuum pressure. The fuel is finely atomized and remains suspended in throat 45 and enters the manifold without contacting the internal surfaces of the carburetor.

Maximum torque requires a rich air-fuel mixture and for economy, a leaner mixture. In the instant carburetor, when the throttle is depressed thereby withdrawing needle shaft 24 from port 33, added fuel is immediately introduced into the air stream. Due to the synchronization between cam 58 and the tapered end 32 of shaft 24, the amount of air required is preset. A rich mixture is thus provided which is necessary for both coolant and maximum torque. Movement of the throttle thus results in normal operation of the vehicle from idle to full throttle.

The curvature of cam 58 is directly related to the taper of needle 32 of shaft 24. For example, if two pounds of fuel pressure is designed to be used in relation to the curvature of cam 58 to produce a 16:1 air-fuel ratio, by increasing the fuel pressure to three pounds, this air-fuel ratio will drop. This forms a richer mixture since the air flow has not been increased. This also results in a smaller air-fuel ratio, e.g. 14:1, which may be desired if power is preferred over economy. If desired, a fuel pressure regulator may be provided to vary the air-fuel ratio.

It is seen that the arc of movement of the cam regulates the velocity of the fall of the valve. The metering needle closing and opening is mechanically linked to the fall of the cam. This mechanical relationship is readily calculable by one skilled in the art for any pre-designated air to fuel ration.

Thus one would determine the amount of fuel it takes mixed with a stated amount of air (air to fuel ratio), to move a predetermined load at 20 m.p.h. This would give a point on a curve. Other points would be plotted for 25, 30, 40, etc. m.p.h. until a generalized curve was developed for a typical average load such as four adults. Then by determining the size of the opening of the metering needle, which is operating at a certain fuel pressure, preferably at about an 18 to 1 fuel ratio for economy, one can determine the flow through the metering needle. Since the operator has already determined the amount of fuel needed to move the fixed load at a predetermined speed, the orifice of the needle can be adjusted such that the flow through the needle corresponds to the amount of fuel needed by the valve to move this same load at the same speed. Since the valve operation is controlled by the movement of the cam, it is readily seen that a linkage may be prepared to correlate the cam action to feed the valve with the variable needle opening to supply the exact amount needed of the fuel for the valves.

One mode of fuel control is to let the vacuum pressure of the engine control the amount of fuel the engine gets. For example, if you are travelling at 55 miles per hour and your vacuum pressure is 16 inches mercury, the vacuum pressure will be providing the engine with enough fuel through a mechanism which it controls, to produce a given air/fuel ratio.

Once the proper fuel is released for idle by adjusting shaft 24 heretofore described, lock nut 29 is tightened against block 28 to prevent rotary movement of shaft 24 which would change idle fuel flow. When the carburetor 10 is at its idle position, the face of valve 44 seats solid against the bottom of block 12 (FIG. 1). When seated, air flow across valve 44 via notches 77 is in an amount sufficient for slow idle. Secondary air enters carburetor 10 through port 277 in block 12 by adjusting screw 17. After the engine is started, the amount of fuel regulated by shaft 24 is synchronized with the air flow through port 74 by adjusting screw 17 to produce the desired revolutions per minute.

Figure 8A:
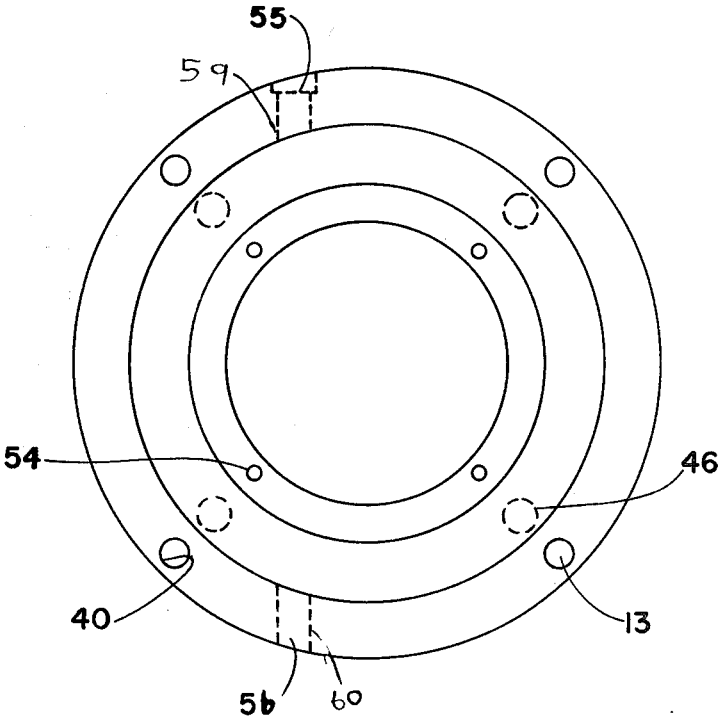
FIG. 8(*a*) is a top plan view of one portion of the carburetor of FIG. 1.
Figure 8B:
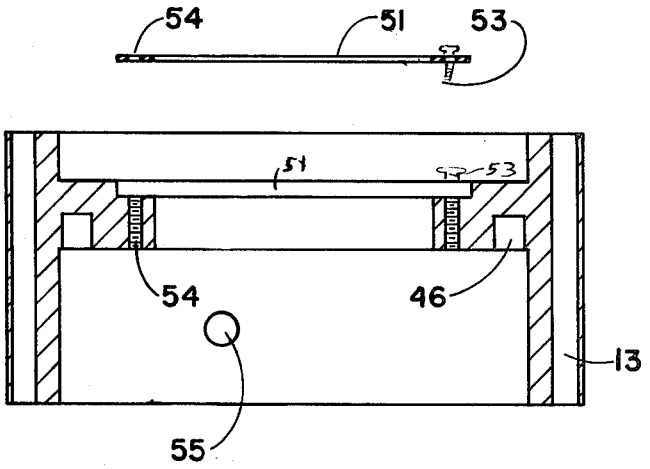

The secondary air also smoothes out fuel flow entering port 33. Air flowing through port 277 carries the entering fuel smoothly downwardly through block 12 where it meets air of high velocity entering between the bottom of block 12 and the upper face of valve 44. Air at this point is entering 360° around throat 45 from chamber 50 encircling valve 44. For example, 16 inches or so of vacuum pressure, considerably more than that present in conventional carburetors, is pulled in the carburetor of the invention. The air flowing across the top surface of valve 44 impacts on itself from an area 360° around throat 45. This doubles the impact force of the atomizing air. This forms an equal vacuum pressure beneath the surface of valve 44 and keeps the fuel that is atomized suspended in the center of carburetor 10. In FIG. 8A, not previously discussed, there is shown a top plan view of the barrel section or main portion of the carburetor 10. FIG. 8B is an elevational view of this portion of the device. However, some of the details have been omitted for the sake of ease of understanding. The portion shown in FIG. 8B is that portion between the numbers IV and V of FIG. 1. Note, however, that the instant view is partially exploded to better illustrate the placement of seal 51, which is employed to retain the air from escaping from valve 44. The use of and function of this seal is described elsewhere herein.

Figure 9:
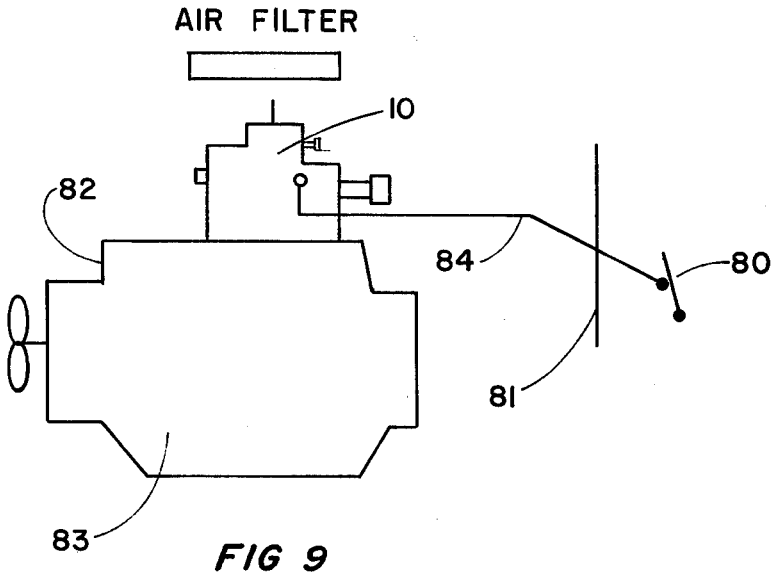
FIG. 9 is a diagrammatic illustration showing the positioning of carburetor 10 for operation.

FIG. 9 depicts the mode of operation of the instant device. The normal connection 84 between the accelerator 80 and the device is the same as in any automobile. The control of the device occurs due to the movement of the cam 58. The device 10 is seen to be mounted on the manifold 82, which is a portion of engine 83. 81 designates the firewall of the car. The balance of the engine is shown only sketchily as it is not relevant to the instant invention. Cam 58 and connections are not shown.

Figure 10:
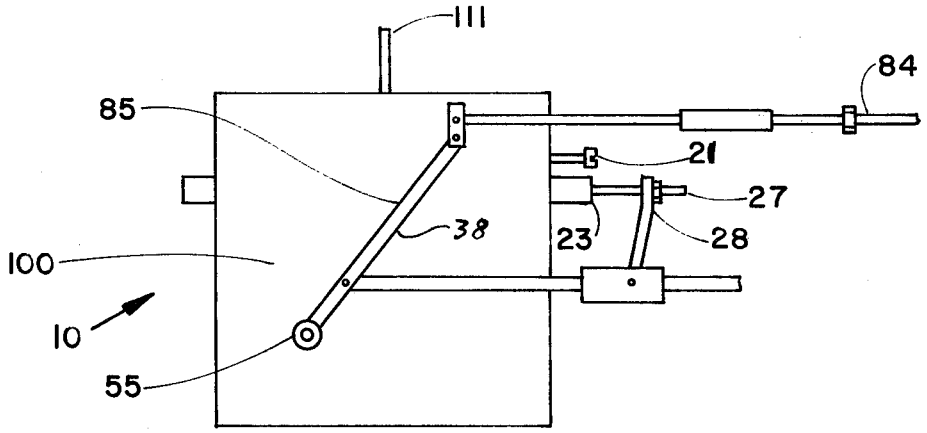
FIG. 10 is a perspective external view of one embodiment of the instant invention.

FIG. 10 is a perspective view of the exterior of the device 10. The exterior is designated 100. Linkage 85 connects cam 58, not shown by cam shaft 55 to the needle. Shaft 111 is for the mounting of the air filter upon carburetor 10. The boss 23 has the shaft portion of the needle 24 therein, which in turn is interconnected to the slotted head 27.

It is seen that the unit 10 can be readily die cast of pot metal the same as other carburetors, but at a lower cost due to its simplicity and fewer parts, and thus can be manufactured to be cost competitive with standard carburetors currently in the marketplace.

In a test using the carburetor of this invention, air flowing between the bottom of block 12 and the face of valve 44 at a vehicle speed of 55 m.p.h. was found to be 702 m.p.h. but the fact that the air impacts against itself in the center of valve 44 creates an impact force of 1404 miles per hour, creating tremendous turbulence, which is a prerequisite for efficient engine operation.

This high speed air impinging with the fuel at exit port 277 atomized the fuel into a fine must due to the high velocity and turbulence. A low pressure area is formed on the underside of valve 44 by the vacuum pressure of the air intake of the engine. This low pressure area, along with the weight of the atomized fuel and gravity, suspends this air fuel mixture in the center of the valve throat 45 without touching its sides. This resulted in a great improvement in carburation, lower emissions, improved fuel economy, increased horsepower and easier start under all conditions.

In a test of a vehicle having carburetor 10 therein, conducted by a State of California licensed motor vehicle pollution control station, the test car being a Ford Granada 6 cylinder, the following resulted:

Idle 0.2% CO; 0.4 PPM HC

Underpower - 20 HP at 50 m.p.h. 0.02% 0.05 PPM HC

When the test was repeated with the standard issue carburetor reinserted and the instant device removed, the results were as follows:

Idle 0.6% CO; 3.0 PPM HC

Underpower - 20 HP at 50 m.p.h. 4% C) 0.90 PPM HC

When carburetor 10 is employed instead of the stock unit supplied with a car, one obtains increased operating efficiency in normal driving as is shown from the following:

1962 Comet w/o a device of this invention; 22 m.p.g.

with a device for this invention; 36 m.p.g.

1976 Ford Granada 6 w/o a device of this invention; 20 m.p.g.

with a device of this invention; 30.7 m.p.g.

w/o means standard issue carburetor is used.

A low temperature mist provided by this invention is so fine it follows the air stream entering all parts thereof equally. This fine mist is a low temperature mixture which expands in the compression stroke providing low cylinder head temperatures which decreases the NOxppm. Also the fine mist aids in the cooling of the valves, and contributes to better efficiency and more power from the same amount of fuel.

It is to be specifically called to the attention of the reader, that linkage 85 is set forth diagrammatically only and is seen to consist of cam operating arm 38 only, and is so marked. The balance of the parts described in detail with respect to FIG. 5 have purposely been omitted in FIG. 10, as well as FIG. 9, as they were not relevant to the aspects being depicted and explained with reference to said FIGS. 9 and 10.

In order to demonstrate that the instant device is intended for useage in various types of climatic conditions, a testing program was conducted using a 1976 Ford Grenada 6 cylinder engine. Home base for the car was Sacramento, California, an area of mild winters, often quite rainy, and long dry summers. The elevation ranges in the area from 100 to 250 feet. The car with the instant device therein started easily and drove smoothly both in summer and winter testing.

To demonstrate cold weather capability, it was driven to Reno, Nevada, where the elevation is about 5,000 feet. The road to Reno requires passing over Donner Summit on Interstate 80 at an elevation of about 7,200 feet. While touring here the car was frequently stopped. It started easily, ran fine and idled smoothly.

During the trip to Reno, the car ran smoothly and no difficulty was encountered in the leaner air. The temperature at the summit was 40° C.

At Reno, the car was left over night and started the next morning in 10° F. weather. The engine started in three or four revolutions and ran smoothly.

This testing pattern was repeated on other trips to Reno, and also from Sacramento to Lake Tahoe. The road to Lake Tahoe in the higher elevations, over 6,000 feet, two lane and requires slower speed driving with frequent slow downs and sometimes periods of idling due either to snow removal equipment, heavy traffic or other problems. At all times the car performed at least as well as those equipped with the stock caruretor, but with superior gas mileage.

The summers in the Sacramento area are usually in the 85° to 95° F. range, with some days as warm as 110°-115° F. The car with the instant device was run at least 4,000 miles in the summer weather. No problems were encountered in idling, start up or running.

It can be seen that the carburetor 10 atomizes fuel to thoroughly and efficiently that no choking mechanism is necessary to provide excess fuel to vaporize. Thus, the carburetor 10 is easier to start in cold climates due to the excess vapor produced.

By selectively adjusting set screws 63, 64, the valve 44 may be adjusted to move at a faster rate between its high and low positions, as heretofore discussed. That is, immediately upon starting, an excessive amount of fall of valve 44 (ie. movement of valve 44 at a fast rate) is needed but a smoother or slower movement fall may be desired later. The movement of cam 58 via arm 38 thus selectively presents screws 63 or 64 for high or low fall of valve 44.

It is seen that the key advantage to the combination of this invention is the ability to independently control both air and fuel by selective adjustment of the rise and fall of valve 44 and the position of needle 25. This is seen by inspection of the control rod 37, and the cam operating arm which are only indirectly tied to the fuel supply needle valve.

Since certain changes may be made in the above apparatus without departing from the scope of the invention herein involved, it is intended that all matter contained in the above description and shown in the accompanying drawings shall be interpreted as illustrative and not in a limiting sense.

I claim:

1. A carburetor for controlling the mixture of fuel and air entering the carburetor and atomizing the same including;

a housing;

a fuel inlet leading into said housing;

a seal block having an air inlet mounted in said housing;

said housing having a head portion surrounding said seal block;

a movable valve in said housing below said seal block having a throat in fluid communication with said air inlet;

an air inlet in said housing surrounding said block in fluid communication with a chamber formed in said housing below said block and surrounding said valve;

a plurality of restricted orifices in said valve in fluid communication with both said throat and said chamber;

adjusting means engaging said fuel inlet for selectively adjusting the ratio of fuel to air in the mixture of fuel and air entering said housing by varying the amount of fuel entering said housing, valve lifting means coupled to said adjusting means and operatively engaging said valve for selectively lifting the same;

seal block positioning means engaging said seal block for adjusting the position of said seal block with respect to said valve to thereby selectively seal said block against the upper surface of said valve; and an outlet in said housing below said throat in fluid communication therewith.

2. In a carburetor adapted to be coupled to a manifold having a housing, a main air supply leading into said housing, a fuel supply leading into said housing, and a variable fuel jet associated with said housing for controlling a mixture of fuel and air in said carburetor, the improvement which comprises:

a seal block fixedly mounted in said carburetor;

said housing including a head portion surrounding said seal block;

a movable valve in said housing below said seal block, said valve having a throat with a plurality of air inlets extending through said valve in fluid communication with said throat, said fuel supply injecting fuel above said valve, said main air supply including a plurality of ports extending through said head portion for introducing air into said housing extending transverse to the direction of fuel injection, said variable fuel jet controlling the amount of fuel thus varying of ratio of fuel and air above said valve;

valve lifting means coupled to the throttle of a vehicle operatively engaging the lower surface of said valve for selectively raising and lowering the same to thereby both create a low pressure area across the underside of said valve and control the atomization of the air-fuel mixture in the center of said throat so that said atomized air-fuel mixture enters the manifold of the engine without touching internal surfaces of said carburetor and seal block positioning means engaging said seal block for adjusting the position of said seal block with respect to said valve to thereby selectively seal said seal block against the upper surface of said valve.

3. In the carburetor of claim 2 wherein said seal block includes a secondary air inlet in fluid communication with said air inlets through said valve and adjusting means disposed in said secondary air inlet for selectively adjusting the amount of air passing through said secondary air inlet for fine tuning said carburetor.

4. In the carburetor of claim 2 wherein said variable fuel jet includes a shaft laterally adjustable in said carburetor having a tapered end extending into the path of said injected fuel for varying the same, said fuel jet being coupled to said valve lifting means for synchronized movement therewith.

5. In the carburetor of claim 2 including valve biasing means for normally biasing said valve in a direction away from said valve lifting means.

6. In the carburetor of claim 2 wherein said valve lifting means includes operating linkage coupled to said fuel jet for synchronized movement thereof, said valve lifting means further including a cam pivotally mounted in said carburetor below said valve, said cam having at least one camming portion abutting against the underside of said valve.

7. In the carburetor of claim 6 wherein said cam includes a main arcuately shaped portion, and said at least one camming portion including an adjustable screw normally bearing against the underside of said valve.

8. In the carburetor of claim 7 wherein said cam includes a second adjustable camming portion spaced from said first-mentioned camming portion having a valve abutting surface terminating in an upper abutment portion at a level below that of said at least one camming portion.

9. A carburetor adapted to be connected to the manifold of an engine including:

a housing;

a seal block mounted in said housing having a secondary air inlet;

said housing including a head portion surrounding said seal block;

a valve mounted in said housing below said seal block having an upper surface in sealing contact with a lower surface of said seal block;

and a plurality of intake notches extending through said valve, seal block positioning means engaging said seal block for adjusting the position of said seal block with respect to said valve to thereby selectively seal said seal block against the upper surface of said valve;

a fuel inlet opening into the interior of said seal block transverse to said secondary air inlet;

a primary air inlet in said head portion of said housing surrounding said seal block and in fluid communication with said notches through said valve;

a throat in said valve in fluid communication with both said notches and said secondary air inlet;

adjusting means on said housing engaging said fuel inlet for varying the amount of fuel entering said housing to thereby vary the ratio of fuel to air in the mixture of air and fuel entering said carburetor through said secondary air inlet and said fuel inlet;

an opening in said housing in fluid communication with said throat; and valve lifting means in said housing below said valve and above said opening for selectively raising and lowering said valve to thereby adjust the amount of air and fuel entering said throat.

10. In the carburetor of claim 9 further including synchronizing means interconnecting both said valve lifting means and said adjusting means for simultaneous movement thereof.

11. In the carburetor of claim 9 wherein said valve is spring-biased in a direction away from said block.

12. In the carburetor of claim 9 wherein the amount of air entering said secondary air inlet is adjustable.

13. In the carburetor of claim 9 wherein said block is adjustable with respect to said valve for sealing the block against the valve.

14. In the carburetor of claim 9 wherein said adjusting means includes a laterally adjustable shaft having a tapered point extending into said fuel inlet.

15. In the carburetor of claim 9 wherein said valve lifting means includes an arcuate cam pivotally mounted in said housing, and a valve camming portion abutting against the underside of said valve.

16. In the carburetor of claim 16 wherein the valve camming portion includes adjusting means for adjusting the rise and fall of said valve.

17. In the carburetor of claim 15 including a second valve camming portion spaced from the first-mentioned valve camming portion, and means associated with said cam for moving said first-mentioned and said second camming portions into selective abutting engagement with said valve.

18. In the carburetor of claim 17 wherein said second camming portion includes adjusting means for adjusting the rise and fall of said valve with respect to said second camming portion.

* * * * *